US007039351B2

(12) United States Patent
Tomizawa

(10) Patent No.: US 7,039,351 B2
(45) Date of Patent: May 2, 2006

(54) TRANSFER MEMBER AND IMAGE FORMING APPARATUS USING THE SAME

(75) Inventor: Takeshi Tomizawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 227 days.

(21) Appl. No.: 10/643,990

(22) Filed: Aug. 20, 2003

(65) Prior Publication Data

US 2004/0096248 A1 May 20, 2004

(30) Foreign Application Priority Data

Aug. 30, 2002 (JP) ..... 2002-256093
Jul. 10, 2003 (JP) ..... 2003-195139

(51) Int. Cl.
*G03G 15/20* (2006.01)
*G03G 15/02* (2006.01)

(52) U.S. Cl. ..... 399/313; 399/176

(58) Field of Classification Search ..... 399/168, 399/174, 176, 297, 313, 314; 492/53, 54, 492/56

See application file for complete search history.

(56) References Cited

U.S. PATENT DOCUMENTS 4,616,125 A 10/1986 Oppitz ..... 219/553
4,720,731 A 1/1988 Suzuki et al.
5,331,383 A 7/1994 Nou et al.
5,656,344 A 8/1997 Sawa et al. ..... 428/36.5
6,283,903 B1 * 9/2001 Onuki et al. ..... 492/56
6,283,904 B1 * 9/2001 Itoh et al. ..... 492/56
6,319,181 B1 * 11/2001 Naoi et al. ..... 492/56
2002/0119324 A1 * 8/2002 Harashima et al. ..... 428/423.3

FOREIGN PATENT DOCUMENTS

JP 05-119646 5/1993
JP 07-049604 2/1995
JP 11-065269 3/1999
JP 2000-179539 6/2000
JP 2000-181251 6/2000

* cited by examiner

*Primary Examiner*—Hoang Ngo
(74) *Attorney, Agent, or Firm*—Fitzpatrick, Cella, Harper & Scinto

(57) ABSTRACT

A charging member for being contactably disposed to an image bearing member and being supplied with a bias voltage includes a resistance layer having an ionic electrical conductivity. The resistance layer comprises a foamed elastic member and satisfies the following relationships:

$B \leqq (5/3) \times A - 0.3$, and $B \geqq 0.6$, wherein A represents a surface bubble-containing density measured, in a state that air bubbles are attached to the surface of said resistance layer, by immersion method according to JIS Z 8807; and B represents a surface bubble-deaerated density measured, in a state that said air bubbles are removed from the surface of said resistance layer, by immersion method according to JIS Z 8807.

20 Claims, 11 Drawing Sheets

| SURFACE BUBBLE-CONTAINING DENSITY A | SURFACE BUBBLE-DEAERATED DENSITY B | INCREASE IN RESISTANCE AFTER CONTINUOUS ENERGIZATION |
|---|---|---|
| 0.68 | 0.73 | ○ |
| 0.47 | 0.53 | × |
| 0.49 | 0.58 | × |
| 0.52 | 0.6 | × |
| 0.54 | 0.60 | ○ |
| 0.54 | 0.59 | × |
| 0.55 | 0.65 | × |
| 0.55 | 0.58 | × |
| 0.57 | 0.60 | ○ |
| 0.58 | 0.63 | ○ |
| 0.58 | 0.7 | × |
| 0.60 | 0.62 | ○ |
| 0.60 | 0.65 | ○ |
| 0.60 | 0.70 | ○ |
| 0.6 | 0.75 | × |
| 0.63 | 0.75 | ○ |
| 0.63 | 0.68 | ○ |
| 0.65 | 0.69 | ○ |

FIG. 9

| DENSITY A | DENSITY B | THICKNESS (mm) | CORE METAL DIAMETER (mm) | INCREASE IN RESISTANCE | CRACK | SLACK |
|---|---|---|---|---|---|---|
| 0.63 | 0.65 | 2 | 20 | ○ | × | ○ |
| 0.65 | 0.67 | 3 | 18 | ○ | × | ○ |
| 0.58 | 0.63 | 4 | 16 | ○ | △ | ○ |
| 0.60 | 0.62 | 4.5 | 15 | ○ | ○△ | ○ |
| 0.63 | 0.65 | 5 | 14 | ○ | ○△ | ○ |
| 0.62 | 0.65 | 5.5 | 13 | ○ | ○△ | ○ |
| 0.64 | 0.68 | 6 | 12 | ○ | ○ | ○ |
| 0.62 | 0.64 | 7 | 10 | ○ | ○ | △ |
| 0.61 | 0.65 | 8 | 8 | ○ | ○ | × |
| 0.62 | 0.65 | 9 | 6 | ○ | ○ | × |
| 0.63 | 0.67 | 10 | 4 | ○ | ○ | × |

FIG. 10

| DENSITY A | DENSITY B | THICKNESS (mm) | CORE METAL DIAMETER (mm) | INCREASE IN RESISTANCE | CRACK | SLACK |
|---|---|---|---|---|---|---|
| 0.63 | 0.65 | 6 | 12 | ○ | ○ | ○ |
| 0.64 | 0.67 | 7 | 12 | ○ | ○ | ○ |
| 0.6 | 0.64 | 8 | 12 | ○ | ○ | ○ |
| 0.62 | 0.65 | 9 | 12 | ○ | ○ | ○ |
| 0.63 | 0.67 | 10 | 12 | ○ | ○ | ○ |

FIG. 11

| DENSITY A | DENSITY B | PRESSURE (Pa) | HOLLOW IMAGE | TRANSFER FAILURE | CHANGE IN RESISTANCE |
|---|---|---|---|---|---|
| 0.63 | 0.65 | $1.2\times10^3$ | ○ | × | ○ |
| 0.65 | 0.67 | $2.5\times10^3$ | ○ | △ | ○ |
| 0.58 | 0.63 | $5.0\times10^3$ | ○ | △ | ○ |
| 0.63 | 0.65 | $7.0\times10^3$ | ○ | ○ | ○ |
| 0.64 | 0.68 | $1.3\times10^4$ | ○ | ○ | ○ |
| 0.62 | 0.64 | $7.3\times10^4$ | ○ | ○ | ○ |
| 0.61 | 0.65 | $9.7\times10^4$ | ○ | ○ | ○ |
| 0.62 | 0.65 | $2.0\times10^5$ | ○ | ○ | ○ |
| 0.63 | 0.67 | $3.0\times10^5$ | △ | ○ | ○ |
| 0.62 | 0.65 | $5.0\times10^5$ | × | ○ | ○ |

FIG. 12

TRANSFER MEMBER AND IMAGE FORMING APPARATUS USING THE SAME

FIELD OF THE INVENTION AND RELATED ART

The present invention relates to a transfer member and an image forming apparatus, such as a printer, a copying machine or a facsimile apparatus, using the transfer member.

FIG. 7 shows a schematic structure of a conventional image forming apparatus.

Referring to FIG. 7, inside a main assembly of the image forming apparatus, an endless-foam intermediary transfer belt 7 moving in a direction of an arrow R7 is disposed. The intermediary transfer belt 7 is constituted by a film of an electroconductive or dielectric resin, such as polycarbonate, polyethylene terephthalate resin or polyvinylidene fluoride. A recording material P such as paper supplied from a paper(-feeding) cassette 11 is fed to a secondary transfer portion (secondary transfer nip portion) via register rollers 14 and is further conveyed toward the left-hand side in the figure.

Above the intermediary transfer member 7, four image forming units Pa, Pb, Pc and Pd each having a substantially identical structure are disposed in series. The structure of the image forming units will be described by taking the image forming unit Pa as an example. The image forming unit Pa includes a photosensitive drum 1*a* which is disposed rotatably in a direction of an arrow. Around the photosensitive drum 1*a*, process equipments such as a primary charger 2*a*, an exposure apparatus 3*a*, a developing apparatus 4*a*, a primary transfer roller (primary transfer member) 5*a*, and a cleaning apparatus 6*a* are disposed. Similarly as in the image forming unit Pa, other image forming units Pb, Pc and Pd also include: primary chargers 2*b*, 2*c* and 2*d*; exposure apparatuses 3*b*, 3*c* and 3*d*; developing apparatuses 4*b*, 4*c* and 4*d*; primary transfer rollers (primary transfer members) 5*b*, 5*c* and 5*d*; and cleaning apparatuses 6*b*, 6*c* and 6*d*. These image forming units Pa, Pb, Pc and Pd form color toner images of magenta, cyan, yellow and black, respectively, in this order, and the respective developing apparatuses 4*a*, 4*b*, 4*c* and 4*d* contain the respective color toners of magenta, cyan, yellow and black.

An image signal based on a magenta component color of an original is projected on the photosensitive drum 1*a* through a polygon mirror (not shown) to form an electrostatic latent image. The electrostatic latent image is supplied with the magenta toner from the developing apparatus 4*a* to provide a magenta toner image. When the magenta toner image reaches a primary transfer portion where the photosensitive drum 1*a* and the intermediary transfer belt 7 abut against each other by the rotation of the photosensitive drum 1*a*, the magenta toner image formed on the photosensitive drum 1*a* is primary-transferred onto the intermediary transfer belt 7 by a primary bias voltage applied from the primary transfer roller 5*a*. The intermediary transfer belt 7 carrying thereon the magenta toner image is conveyed to the image forming unit Pb, where a cyan toner image which has been formed by that time on the photosensitive drum 1*b* in the same manner as in the magenta toner image described above is primary-transferred onto the magenta toner image in a superposition manner.

Similarly, as the intermediary transfer belt 7 advances to the image forming units Pc and Pd, a yellow toner image and a black toner image are (primary-)transferred onto the above-mentioned magenta and cyan toner images in a superposition manner at the respective primary transfer portions. Thereafter, by that time, the recording material P taken out from the paper cassette 11 reaches a secondary transfer portion (secondary transfer nip portion) between the intermediary transfer belt 7 and a secondary transfer roller (secondary transfer member) 15A. At the secondary transfer portion, the above-described four color toner images are secondary-transferred onto the recording material P at the same time by a secondary bias voltage applied to the secondary transfer roller.

The recording material P is carried from the secondary transfer portion to a fixing apparatus 16 and is heated and pressed between a fixation roller 17 and a pressure roller 18 in the fixing apparatus 16. As a result, the toner image is fixed on the recording material P. The fixing apparatus 16 includes a mechanism for coating a release oil (e.g., silicone oil) onto the surface of the fixation roller 17 in order to enhance a releasability between the recording material P and the fixation roller 17. This release oil is also attached to the recording material P. The recording material P on which the toner image is fixed is discharged in a discharge tray (not shown). Incidentally, in the case of performing automatic double-sided image formation on the recording material P, the recording material P after being subjected to image formation at its front side (first surface) is subjected to image formation also at its back side (second surface) by passing it through a recording material inversion passage (not shown) and repeating the above-mentioned cycle of image forming process.

In the image forming apparatus described above, an electroconductive roller has been frequently employed as the primary transfer member or the secondary transfer member in view of durability, cost and environmental friendliness. Particularly, in the steps of transferring the toner image from the photosensitive drums 1*a*–1*d* to the intermediary transfer belt 7 or from the intermediary transfer belt 7 to the recording material P, a transfer roller comprising a cylindrical core metal and a rubber wound about the core metal, having a controlled resistivity of $1.0\times10^{5}$–$1.0\times10^{10}$ ohm.cm is dominantly adopted as the transfer member so that transfer electric charges are sufficiently supplied to the intermediary transfer belt 7 and the recording material.

Representative means for adjusting a resistance of the transfer roller includes one of electron-conductive type and ion-conductive type. The former (electron-conductive type) comprises a rubber and electroconductive particles, dispersed in the rubber, such as electroconductive carbon black, metal powder or metal oxide particles. On the other hand, the latter (ion-conductive type) comprises a rubber and an ion-conductive material, kneaded in the rubber, such as epichlorohydrin rubber; tetracyanoethylene and its derivatives; benzoquinone and its derivatives; inorganic ion substances including lithium perchlorate, sodium perchlorate and calcium perchlorate; cationic surfactants; and amphoteric surfactants.

However, these conventional transfer rollers have encountered the following problems.

The electroconductive type transfer roller exhibits a voltage characteristic as shown in FIG. 8. As apparent from FIG. 8, when a voltage applied to the transfer roller is increased, the resultant volume resistivity is lowered. For this reason, when a voltage exceeding a certain voltage is applied, the transfer roller causes leakage in some cases. Further, an irregularity in resistivity due to nonuniform dispersion of an electron conductive agent in a rubber becomes large when compared with the case of the ion-conductive type transfer roller.

On the other hand, the ion-conductive type transfer roller, as shown in FIG. 2, exhibits an increase in resistance larger than the electron-conductive type transfer roller. Referring to FIG. 2, in the case of performing transfer control based on constant-current control, an applied voltage value is increased when a resistance value is increased. This phenomenon (increase in resistance) may be attributable to less current conduction caused by occurrence of dissociation and polarization of an ionic substance at the time of continuously applying a current of the same polarity in the case of the ion-conductive type transfer roller exhibiting electroconductivity by the ionic substance. In addition, in the case where the ion-conductive layer is comprised of a foamed layer, it is considered that a degree of resistance increase becomes worse due to discharge within bubbles leading to accelerated deterioration of rubber. When the resistance is increased, a voltage with respect to a transfer current necessary to transfer the toner image onto the recording material becomes large, image failure due to abnormal electric discharge is caused to occur or the resultant apparatus is required to have a large size in order to ensure a creepage distance between the charging member and its surroundings in view of safety design. Further, a larger voltage is required, thus resulting in an increased cost of high-voltage transformer.

In these circumstances, as a measure against the polarization of the ion-conductive substance, Japanese Laid-Open Patent Application (JP-A) Hei 7-49604 discloses an improved method wherein a bipolar bias voltage is applied to a transfer roller at a certain interval. Further, JP-A Hei 11-65269 describes that epichlorohydrin rubber (ECO) is mixed in nitrile-butadiene rubber (NBR) in order to remedy a difficulty of NBR being liable to deteriorate due to ozone by the presence of a double bond in its main chain. However, these documents fail to describe measures against discharge of a foamed layer.

Further, JP-A 2000-179539 has proposed an electroconductive roller formed of a plurality of layers including an electron-conductive layer and an ion-conductive layer as an electroconductive roller capable of providing a stable resistance value against a change with time. However, by the formation of two-layer structure, a production cost is increased and an increase in resistance of the ion-conductive layer cannot be avoided.

With respect to a cleaning performance of the transfer roller, JP-A 2000-181251 has proposed a transfer roller having a toner release layer. However, the transfer roller is required to include an adequate cleaning mechanism (e.g., provision of a transfer resin cleaning blade or a waste toner box) against contamination at the back side of a recording material because the transfer roller is excellent in toner releasability, thus resulting in an increase in cost and a large-sized member. JP-A Hei 5-119646 describes a transfer roller such that its surface layer is formed of an elastic member comprising a foamed body having a closed cell structure, and a bias voltage of a polarity identical to a transfer bias voltage is applied to the transfer roller after a bias voltage of a polarity opposite to the transfer bias voltage, thereby to effect cleaning.

Further, with respect to an occurrence of a so-called "hollow" image which is such a phenomenon that a central portion of character or thin line is not transferred, it has been known that a factor of hardness of a transfer roller is dominant. Further, the transfer roller is required to ensure a sufficient nip and stable surface properties for a long term in order to tightly grip the recording material since the transfer roller also has a function of carrying the recording material.

Accordingly, in order to ensure a sufficient transfer nip, the transfer roller is required to have a lower hardness.

As described above, in order to compatibly satisfy stable conveyance and image forming performances for a long period of time, the transfer roller must avoid a useless increase in its hardness.

SUMMARY OF THE INVENTION

An object of the present invention is to provide a charging member or a transfer member capable of suppressing a change in resistance by continuous use and providing a stable transferability for a long period of time.

Another object of the present invention is to provide an image forming apparatus using the transfer member.

According to the present invention, there is also provided a charging member for being contactably disposed to an image bearing member and being supplied with a bias voltage, comprising:

a resistance layer having an ionic electrical conductivity, wherein said resistance layer comprises a foamed elastic member and satisfies the following relationships:

$$B \leqq (5/3) \times A - 0.3, \text{ and}$$

$$B \geqq 0.6,$$

wherein A represents a surface bubble-containing density measured, in a state that air bubbles are attached to the surface of said resistance layer, by immersion method according to JIS Z 8807; and B represents a surface bubble-deaerated density measured, in a state that said air bubbles are removed from the surface of said resistance layer, by immersion method according to JIS Z 8807.

According to the present invention, there is also provided an image forming apparatus, comprising:

image forming means for forming an image on an image bearing member, and a transfer member for being contactably disposed to the image bearing member and transferring the image formed on the image baring member by applying a bias voltage to said transfer member;

wherein said transfer member comprises a resistance layer having an ionic electrical conductivity, said resistance layer comprising a foamed elastic member and satisfying the following relationships:

$$B \leqq (5/3) \times A - 0.3, \text{ and}$$

$$B \geqq 0.6,$$

wherein A represents a surface bubble-containing density measured, in a state that air bubbles are attached to the surface of said resistance layer, by immersion method according to JIS Z 8807; and B represents a surface bubble-deaerated density measured, in a state that said air bubbles are removed from the surface of said resistance layer, by immersion method according to JIS Z 8807.

These and other objects, features and advantages of the present invention will become more apparent upon a consideration of the following description of the preferred embodiments of the present invention taken in conjunction with the accompanying drawings.

with respect to an electron-conductive type transfer roller and an ion-conductive transfer roller.

Figure 3:
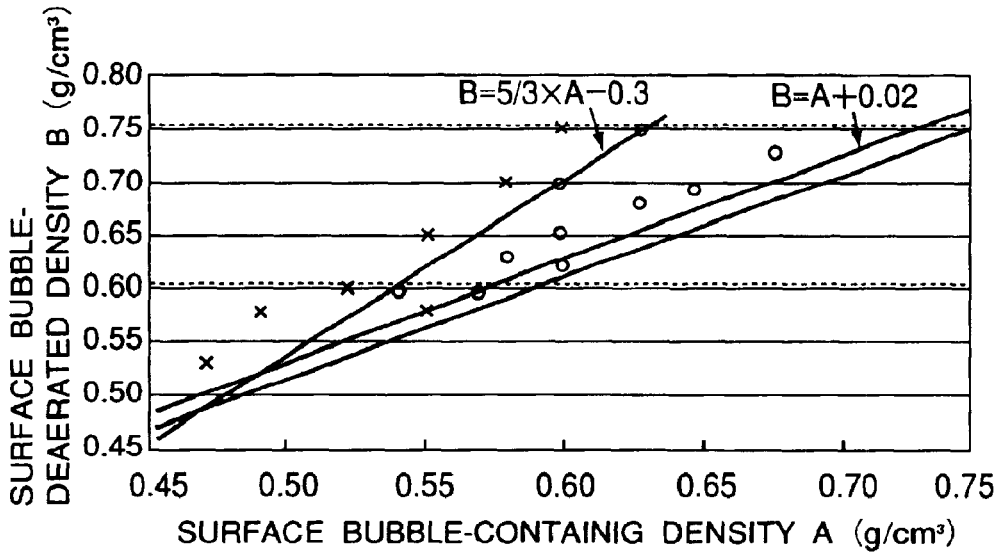

FIG. 3 is a graph showing a relationship between a surface bubble-deaerated density B in conjunction with an increase in resistance with time.

Figure 4:
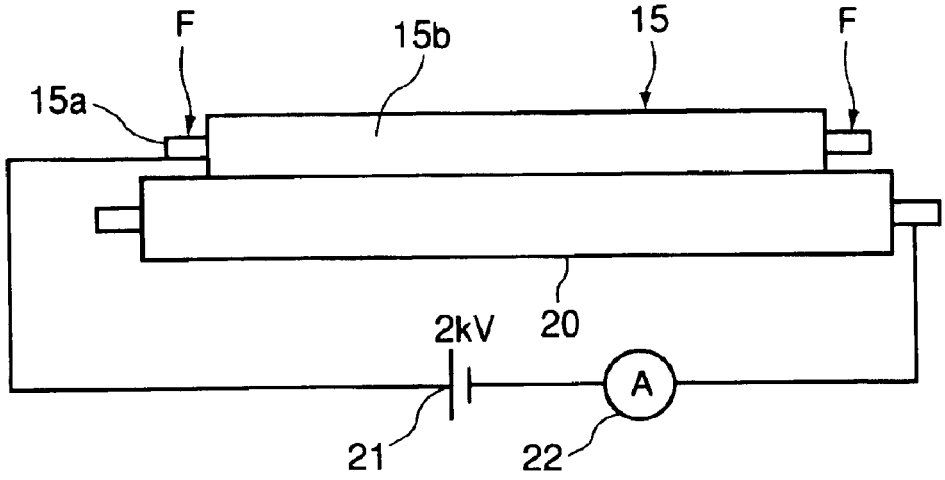

FIG. 4 is a schematic view for illustrating a method of measuring a volume resistivity of a transfer roller.

Figure 5:
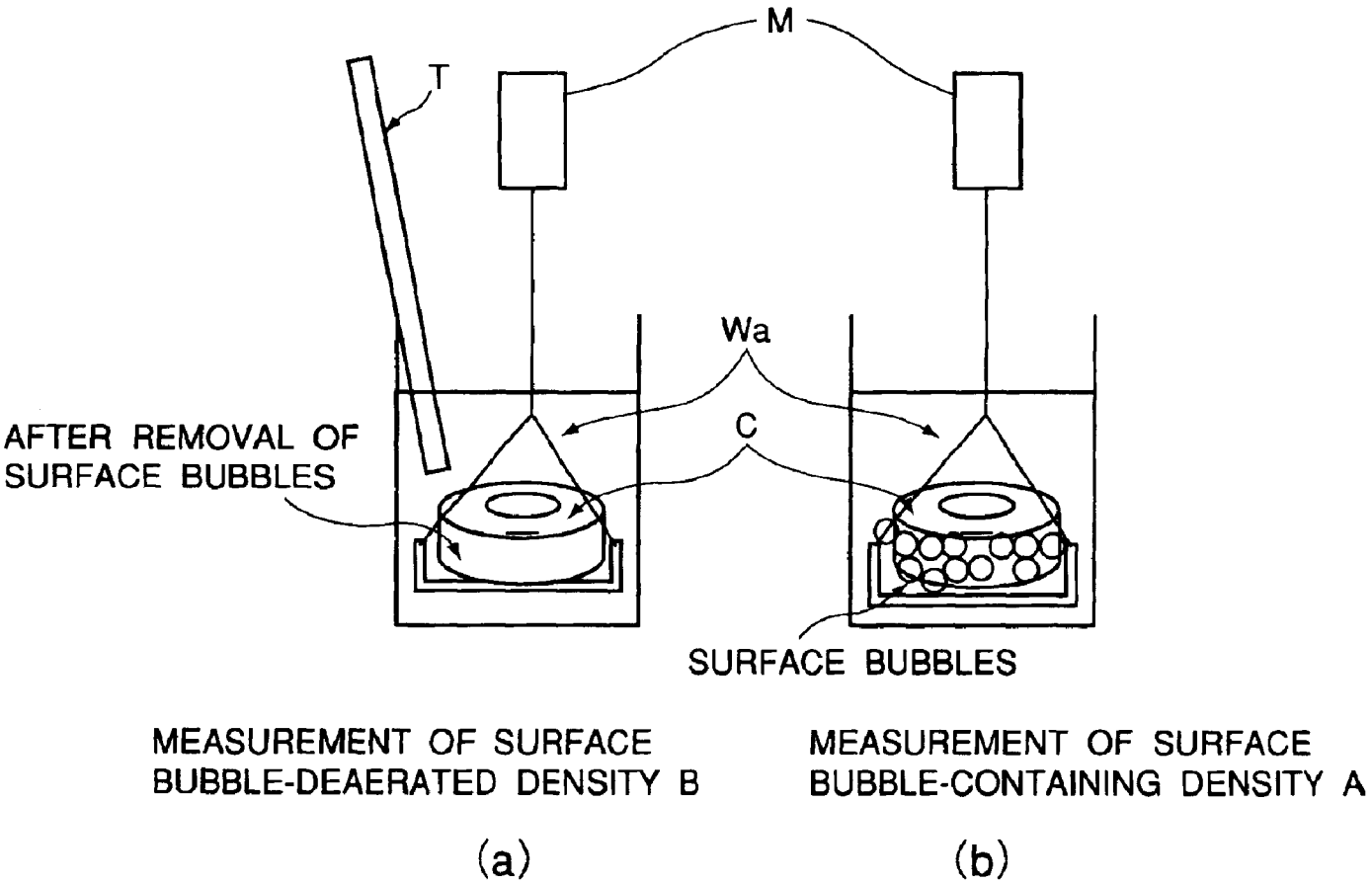

FIG. 5 includes schematic views wherein at (a) is shown a method of measuring the surface bubble-deaerated density B and at (b) is shown a method of measuring the surface bubble-containing density A.

Figure 6:
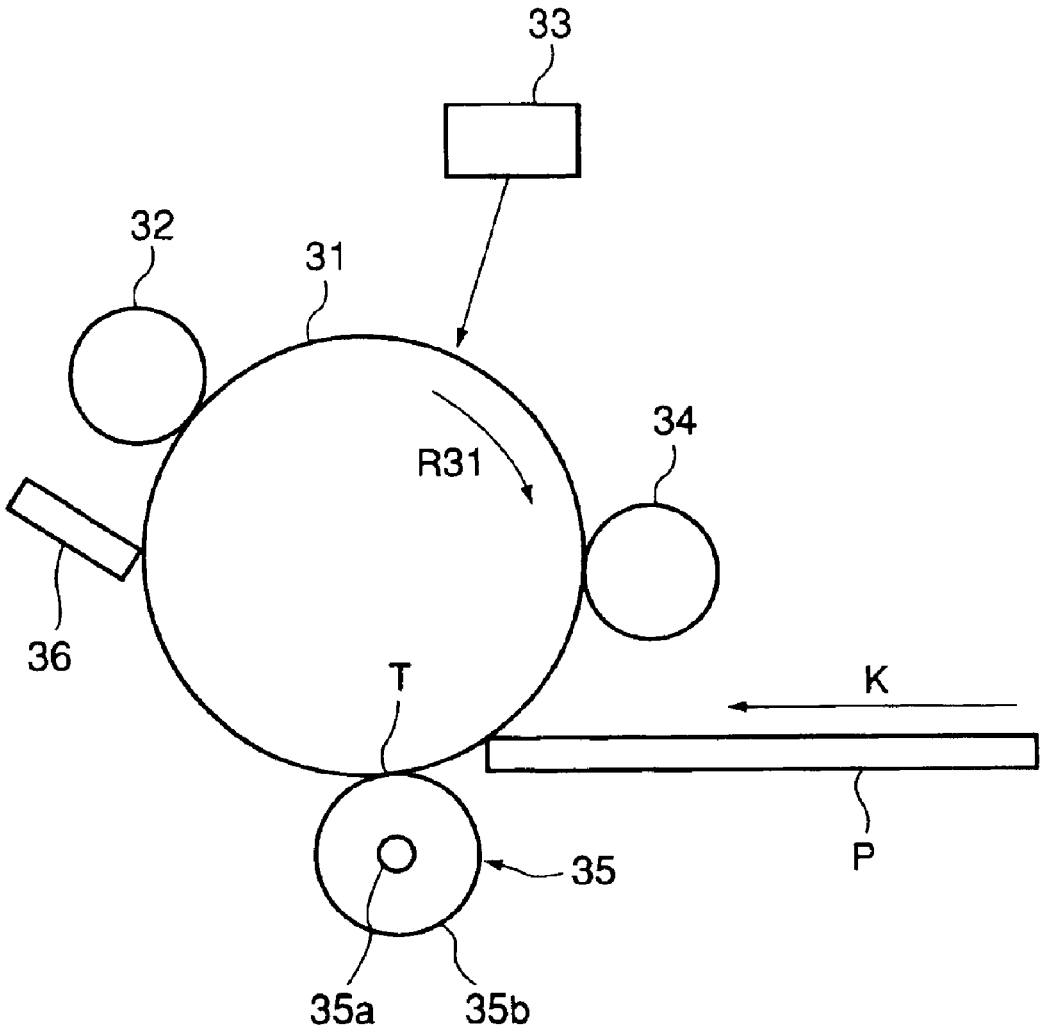

FIG. 6 is a longitudinal sectional view showing a schematic structure of an image forming apparatus according to Embodiment 4.

Figure 7:
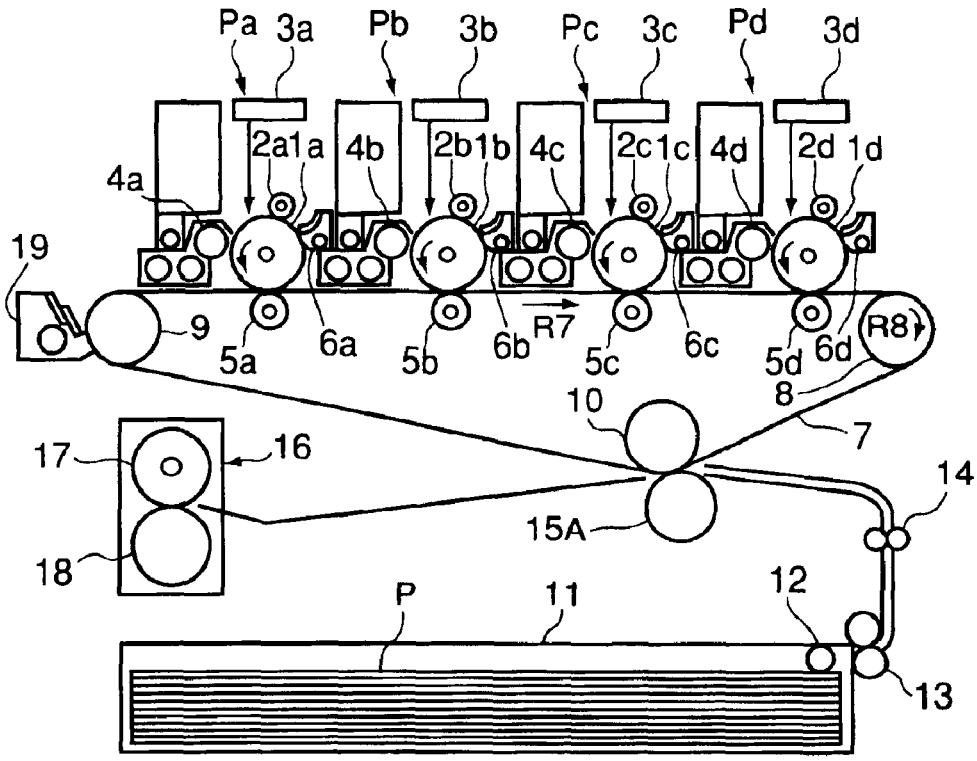

FIG. 7 is a longitudinal sectional view showing a schematic structure of a conventional image forming apparatus.

Figure 8:
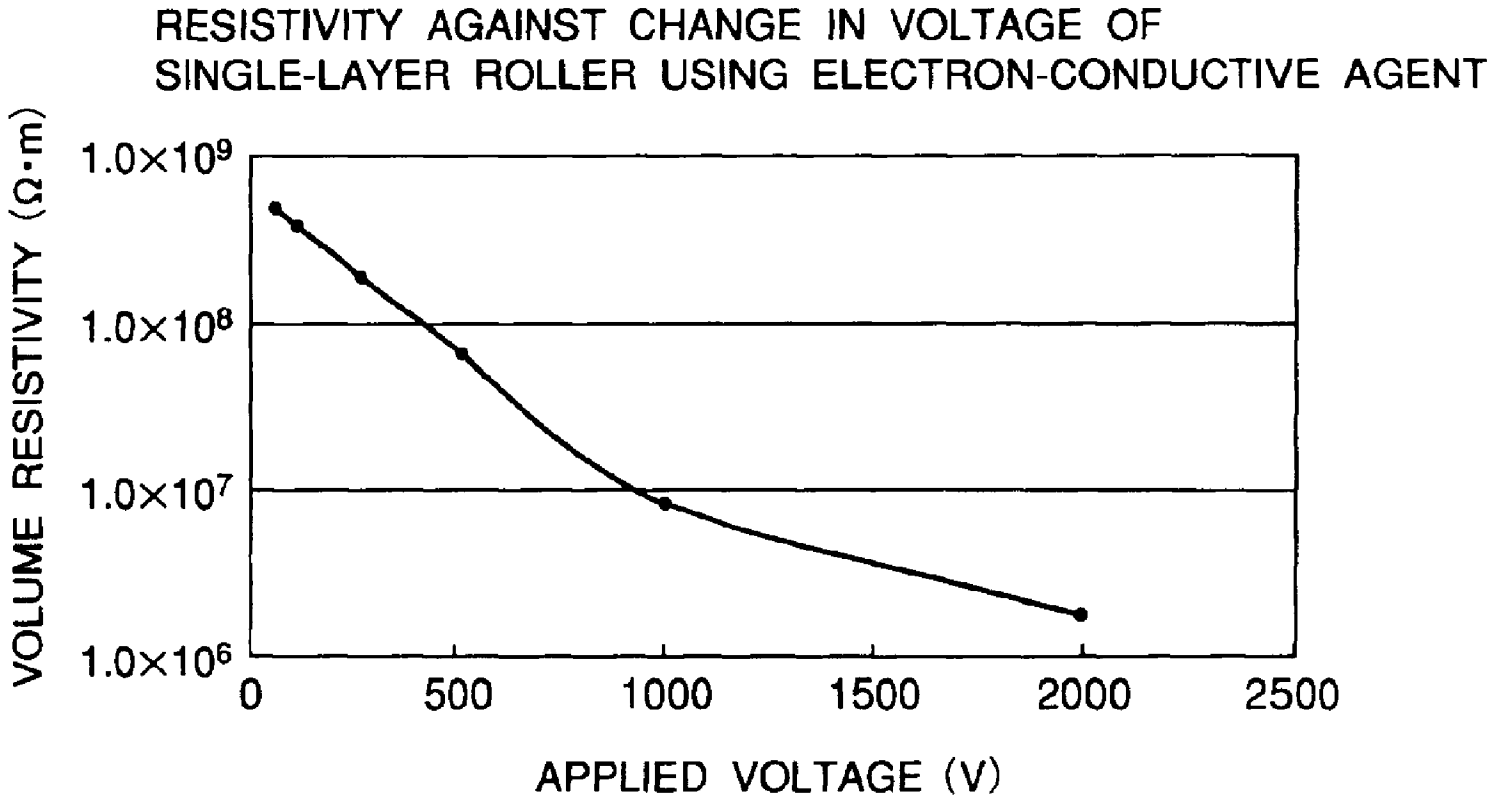

FIG. 8 is a graph showing volume resistivity values against a change in voltage of a single-layer roller using an electron-conductive agent.

FIG. 9 is a table showing evaluation results in terms of an increase in resistance after continuous energization when a combination of the surface bubble-containing density A and the surface bubble-deaerated density B is changed with respect to a transfer roller.

FIG. 10 is a table showing evaluation results in terms of resistance increase, occurrence of crack and occurrence of deflection when a plurality of transfer rollers having different thickness of resistance layer and different core metal diameters are used.

FIG. 11 is a table showing evaluation results in terms of resistance increase, occurrence of crack and occurrence of deflection when a plurality of transfer rollers having different thicknesses of resistance layer but having a certain core metal diameter are used.

FIG. 12 is a table showing evaluation results in terms of hollow image, transfer failure and change in resistance when a plurality of transfer rollers having different abutting pressures of the transfer rollers against photosensitive drum are used.

DETAILED DESCRIPTION OF THE PREFERRED EMBODIMENTS

Hereinbelow, preferred embodiments of the present invention will be described with reference to the drawings. In the respective drawings, identical reference numerals or symbols represent identical members or functions, and repeated explanation therefore will be omitted appropriately.

<Embodiment 1>

Figure 1:
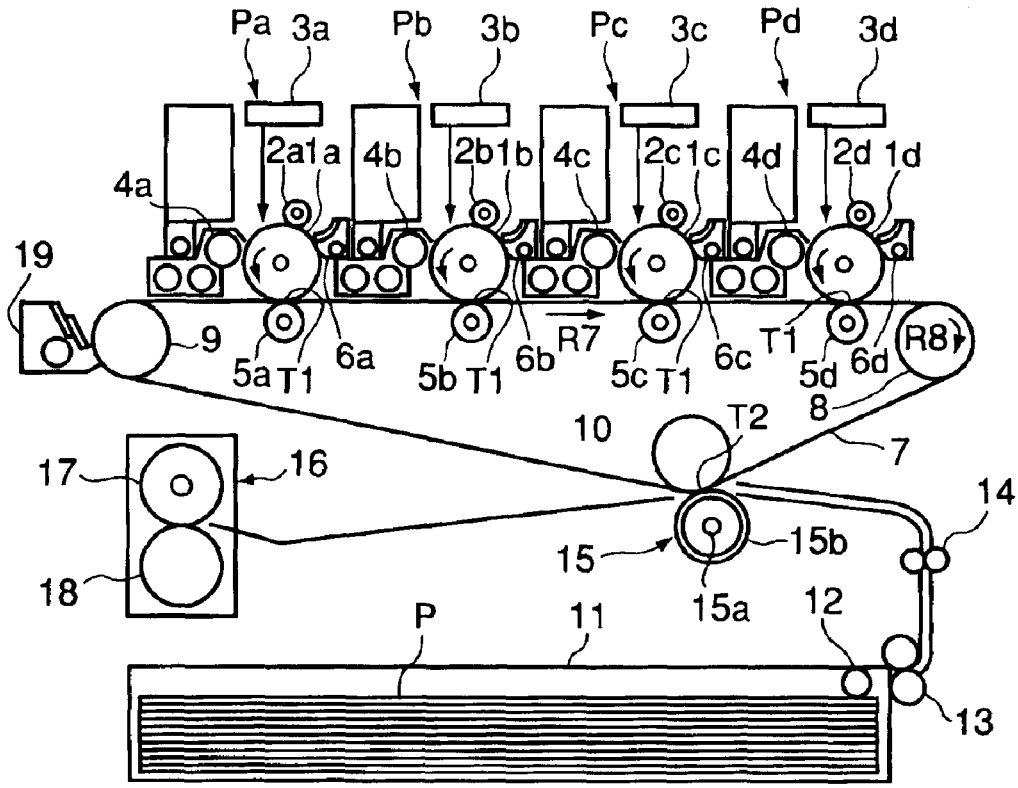
FIG. 1 is a longitudinal sectional view showing a schematic structure of an image forming apparatus according to Embodiment 1.

FIG. 1 shows an image forming apparatus according to this embodiment as an example of the image forming apparatus according to the present invention. In this embodiment, the image forming apparatus shown in FIG. 1 is a (four color-based) full-color image forming apparatus of an electrophotographic type using an intermediary transfer belt as an intermediary transfer member (image bearing member or transfer medium), and FIG. 1 is a longitudinal sectional view showing a schematic structure thereof.

Referring to FIG. 1, inside a main assembly (not shown) of the image forming apparatus, an endless-foam intermediary transfer belt 7 moving (rotating) in a direction of an arrow R7 is disposed. In this embodiment, the intermediary transfer belt 7 employs electroconductive polyimide. Below the intermediary transfer belt 7, a paper(-feeding) cassette 11 is disposed. In the paper cassette 11, a recording material P (such as paper or a transparent film) as a transfer medium is accommodated and is fed from the paper cassette 11, conveyed by conveyance (feeding) rollers 13, and is sent to a secondary transfer portion (secondary transfer nip portion) T2 formed between the intermediary transfer belt and a secondary transfer roller (transfer member) 15 by regist rollers 14 at a predetermined timing.

Above the intermediary transfer member 7, four image forming units Pa, Pb, Pc and Pd each having a substantially identical structure are disposed in this order from an upstream side of the rotation direction (the arrow R7 direction) of the intermediary transfer belt 7. The respective image forming units Pa, Pb, Pc and Pd include drum-type electrophotographic photosensitive members (referred to as "photosensitive drums") 1*a*, 1*b*, 1*c* and 1*d*, as image bearing members, which are disposed rotatably in a direction of an arrow. Around the respective photosensitive drums 1*a*, 1*b*, 1*c* and 1*d*, process equipments such as primary charges (charging means) 2*a*, 2*b*, 2*c* and 2*d*, exposure apparatuses (exposure means) 3*a*, 3*b*, 3*c* and 3*d*, developing apparatuses (developing means) 4*a*, 4*b*, 4*c* and 4*d*, primary transfer rollers (transfer members) 5*a*, 5*b*, 5*c* and 5*d*, and cleaning apparatuses (cleaning means) 6*a*, 6*b*, 6*c* and 6*d* are disposed substantially in this order along the rotation direction (counterclockwise direction in FIG. 1) of the photosensitive drums.

These image forming units Pa, Pb, Pc and Pd and different in that they form color toner images of magenta, cyan, yellow and black, respectively. The respective developing apparatuses 4*a*, 4*b*, 4*c* and 4*d* contain the respective color toners of magenta, cyan, yellow and black.

The photosensitive drum 1*a* is rotationally driven in a direction of the arrow indicated therein by drive means (not shown), and the surface thereof is uniformly charged by the primary charger 2 to a predetermined polarity and a predetermined potential. On the surface of the photosensitive drum 1*a* after the charging, an electrostatic latent image is formed by the exposure apparatus 3*a*. Specifically, laser light which is ON/OFF-controlled in correspondence with an image signal based on a magenta component color of an original is emitted from a laser oscillator of the exposure apparatus 3 and is applied onto the photosensitive drum 1*a* through a polygon mirror (not shown) to form an electrostatic latent image at the surface of the photosensitive drum 1*a* by removal of electric charges at an irradiated portion of the laser light. The electrostatic latent image is developed with the magenta toner supplied from the developing apparatus 4*a* as a magenta toner image. When the magenta toner image reaches a primary transfer portion T1 where the photosensitive drum 1*a* and the intermediary transfer belt 7 abut against each other by the rotation of the photosensitive drum 1*a*, the magenta toner image formed on the photosensitive drum 1*a* is primary-transferred onto the intermediary transfer belt 7 by applying a transfer bias voltage to the primary transfer roller 5*a*. The residual toner remaining on the surface of the photosensitive drum 1*a* after the toner image transfer is removed by the cleaning apparatus 6*a* to be subjected to a subsequent image formation. The intermediary transfer belt 7 carrying thereon the magenta toner image is conveyed to the image forming unit Pb, where a cyan toner image which has been formed by that time on the photosensitive drum 1*b* through the same image forming process as in the magenta toner image described above is primary-transferred onto the magenta toner image in a superposition manner.

Similarly, as the intermediary transfer belt 7 advances to the image forming units Pc and Pd, a yellow toner image and a black toner image are (primary-)transferred onto the above-mentioned magenta and cyan toner images in a superposition manner at the respective primary transfer portions T1. On the other hand, the recording material P supplied from the paper cassette 11 by the paper-feeding roller 12 is conveyed by the conveyance rollers 13 and is sent to a secondary transfer portion (secondary transfer nip portion) T2 so as to be timed to the toner image on the intermediary transfer belt 7. At that time, a secondary transfer bias voltage is applied to the secondary transfer roller 15 (transfer member), whereby the above-described four color toner images are secondary-transferred onto the recording material P at the same time.

The residual toner remaining on the surface of the intermediary transfer belt 7 after the secondary transfer is removed by an intermediary transfer belt cleaning apparatus 19 to be subjected to a subsequent image formation.

On the other hand, the recording material P after the secondary transfer of toner image is sent to a fixing apparatus 16, where the toner image is heated and pressed between a fixation roller 17 and a pressure roller 18. As a result, the toner image is fixed on the surface of the recording material P. The fixing apparatus 16 includes a mechanism for coating a release oil (e.g., silicone oil) onto the surface of the fixation roller 17 in order to enhance a releasability between the recording material P and the fixation roller 17. This release oil is also attached to the recording material P. The recording material P on which the toner image is fixed is discharged in a discharge tray (not shown). Incidentally, in the case of performing automatic double-sided image formation on the recording material P, the recording material P after being subjected to toner image fixation at its front side (first surface) is subjected to image formation also at its back side (second surface) by passing it through a recording material inversion passage (not shown) to effect both side-inversion and, after being sent again to the secondary transfer portion T2, by repeating the above-mentioned image forming process. The recording material P having the formed toner images on both sides thereof is discharged to the discharge tray, thus completing four color-based full-color image formation.

In this embodiment, as the secondary transfer roller 15 for the above-mentioned image forming apparatus, various transfer rollers described below were prepared and subjected to comparison (comparative experiment).

Each secondary transfer roller 15 is constituted by a core metal 15*a* and a resistance layer 15*b* which cylindrically surrounds the core metal 15*a*. The transfer roller 15 has an outer diameter of 24 mm and a diameter of core metal 15*a* of 12 mm. The resistance layer 15*b* is formed of a foamed rubber (foamed elastic member) principally comprising nitrile-butadiene rubber (NBR).

The transfer roller may be prepared as follows. A rubber material prepared by adding azobisisobuturonitrile (AIBN) as a foaming agent to NBR is subjected to extrusion by a molding machine and is bonded with a primer to a circumferential surface of a core metal made of stainless steel (SUS). Thereafter, the resultant molded product is vulcanized under heating to generate foamed portion having a closed cell within the rubber material. The foamed product is surface-polished so as to have a predetermined outer diameter, thus preparing a transfer roller. As the foaming agent other than AIBN described above, it is also possible to use azodicarbonamide (ADCA) or dinitrosapentamethylenetetramine (DPT). Further, as a material for imparting ionic conductivity, it is possible to knead, in the rubber, epichlorohydrin rubber; tetracyanoethylene and its derivatives; benzoquinone and its derivatives; inorganic ionic substances including lithium perchlorate, sodium perchlorate and calcium perchlorate; cationic surfactants; and amphoteric surfactants; etc.

The resultant transfer roller has a sponge layer which has been adjusted to exhibit a volume resistivity in the range of $7\times10^7$–$1.2\times10^8$ ohm.cm in an environment of a temperature of 23° C. and a relative humidity of 50%.

The transfer roller has a roller hardness of 25–40 degrees, as a whole, measured as ASKER-C hardness under a load of 500 gf.

FIG. 4 is a schematic view for illustrating a measurement method of the volume resistivity of the transfer roller.

Referring to FIG. 4, a transfer roller 15 is pressed against a metal roller 20 having a diameter of 30 mm while applying a total load of 1000 gf to both longitudinal ends of the core metal 15*a* (500 gf per each longitudinal end). The metal roller 20 is rotated at a speed of 20 rpm, whereby the transfer roller 15 is rotated. At that time, a bias voltage of 2 kV is applied from a power supply 21 to the core metal 15*a*, and a current value passing through the metal roller 20 is monitored by an ammeter 22. When a current value at that time is I(A) and the transfer roller 15 has a rubber layer length of L, a core metal diameter of r2 and a roller outer diameter of r1; a volume resistivity (ρv) of the transfer roller 15 is obtained according to the following equation:

$$\rho v=\{2\pi L\times2000\}/\{I\times1\underline{\ln}(r\mathbf{1}/r\mathbf{2})\}.$$

In the present invention, the volume resistivity of the transfer roller is not limited to the above range of $7\times10^7$–$1.2\times10^8$ ohm.cm. The volume resistivity of the transfer roller may vary depending on, e.g., an image forming speed (process speed) of the image forming apparatus used and a thickness of the resistance layer employed, and my preferably be in the range of $1.0\times10^6$–$1.0\times10^{10}$ ohm.cm.

If the volume resistivity is below $1.0\times10^6$ ohm.cm, a transfer current flows in a non-paper feeding portion, so that a resultant transfer voltage is not increased to result in an insufficient supply of electric charges to a paper-feeding portion. Further, a difference in supplied electric charge density between an image forming portion and a non-image forming portion is caused to occur, so that a phenomenon such that a solid black image is scattered over a solid white portion is caused. On the other hand, when the volume resistivity exceeds $1.0\times10^{10}$ ohm.cm, a transfer voltage with respect to a transfer current required for transfer becomes too high, so that an abnormal discharge image, such as a white-dropout image, is caused to occur in some cases. Further, discharge within the sponge rubber layer is liable to occur, thus accelerating an increase in resistance in continuous use (energization) in some cases. Accordingly, in order to obviate the above-mentioned difficulties, the volume resistivity may more preferably be in the range of $1.0\times10^7$–$1.0\times10^9$ ohm.cm.

The pressure (abutting pressure) between the transfer roller 15 and the intermediary transfer belt 7 is set to $3.3\times10^4$ Pa (Kgf/m$^2$) in this embodiment in order to satisfy a transferability of a plurality of color image images (two, three or four color toner images) onto thick paper or surface-roughened paper as the recording material P. In such an instance, a total load at the time of abutment of the transfer roller is 4 kg and a transfer nip portion has a width of 4 mm and a longitudinal length of 300 mm.

A surface bubble-containing density A (g/cm$^3$) and a surface bubble-deaerated density B (g/cm$^3$) of the NBR resistance layer used in this embodiment are measured by a density measuring method (water immersion method or substitution method in water) in accordance with JIS Z 8807.

As a measurement equipment, it is possible to use, e.g., an electronic balance-type density meter.

FIG. 5 shows an example of the method of measuring the surface bubble-containing density A and the surface bubble-deaerated density B.

The density is ordinarily measured in the following manner.

Assuming that a density of water (Wa) at a given temperature is ρ, a mass of a foamed layer (member) is m, a total mass of specimen C and a sinker (not shown) in water is wg (g: acceleration of gravity), and a mass of the sinker in water is ωg (g: acceleration of gravity) the density can be calculated by: $m\rho/\{m-(w-\omega)\}$ (g/cm$^3$).

Accordingly, the density can be measured through the following steps (a), (b) and (c).

(a) A water temperature in a water vessel is measured by a thermometer (T), and the density ρ of the water (Wa) in the water vessel is measured.

(b) The mass (m) of the specimen (foamed member) is measured (in air).

(c) The specimen is submerged into the water vessel by using the sink (since the specimen is lighter than water), and a mass (w−ω) of the specimen in water is measured by the measuring equipment (M) to obtain the density according to the above formula.

The surface bubble-containing density A and the surface bubble-deaerated density B are distinguished from each other in the following manner.

(1) Surface Bubble-containing Density A

A cylindrical (doughnut-shaped) specimen C (foamed member or roller) having an inner diameter of 12 mm, an outer diameter of 24 mm and a height of 20 mm is prepared by removing the core metal (shaft) 15*a* from the transfer roller 15, and is subjected to density measurement by using the above-mentioned measuring equipment (M) in the manner described above.

In this case, as shown in FIG. 5(*b*), the specimen C is immersed in water in such a state that air bubbles are attached to the surface of the specimen C. The density measured in such a state is referred to as "surface bubble-containing density A".

The surface bubble-containing density A is a measure of a degree of formation of foaming portion at the surface of the specimen (foamed member). A larger foaming portion is liable to possess such a property that a larger amount of air bubbles is formed at the roller surface (the surface of the specimen) when the specimen (roller) is immersed in water. Accordingly, a smaller A value represents a state of roller containing a larger amount of air including air at the roller surface, i.e., such a state that a larger amount of foaming portion is formed within the roller and at its surface.

(2) Surface Bubble-deaerated Density B

A specimen (roller) C is prepared in the same manner as in the case of the surface bubble-containing density A described above. The thus prepared specimen C is subjected to removal of air bubbles at the roller surface in water, e.g., by compression ten times, after it is sufficiently immersed in water. Thereafter, as shown in FIG. 5(*a*), the specimen C (roller) is subjected to measurement of density in a state wherein air bubbles at the roller surface are completely removed. The density measured in such a state is referred to as "surface bubble-deaerated density B". Incidentally, in the present invention, the manner of removing air bubbles from the roller surface is not limited to the compression.

The surface bubble-deaerated density B is a measure of a density within the specimen (roller) C exclusive of its surface state. In the case of foamed material, a smaller B value represents a state of roller containing a larger amount of air within the roller, i.e., such a state that a larger amount of foaming portion is formed within the roller.

FIG. 9 shows evaluation results of 18 transfer rollers having different combinations of the surface bubble-containing density A and the surface bubble-deaerated density B.

Figure 2:
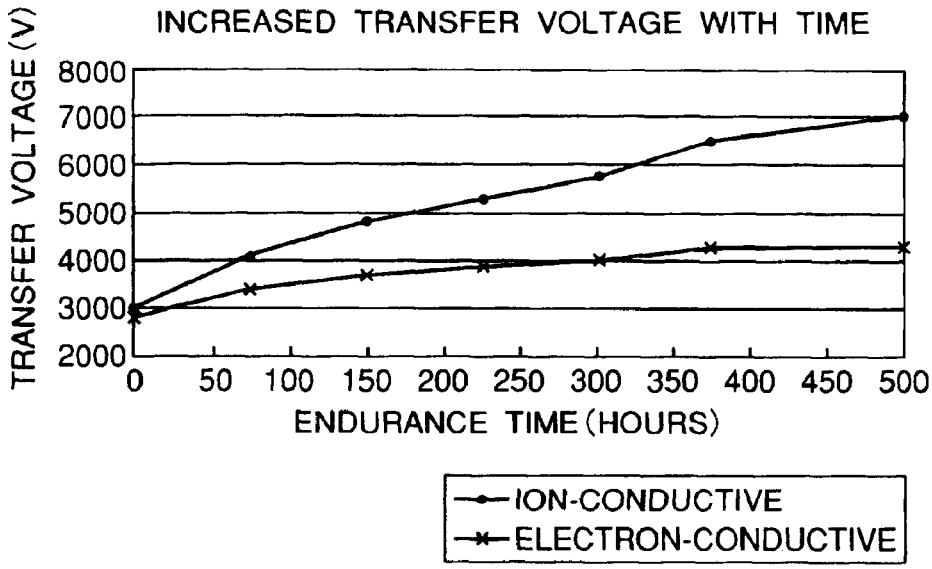
FIG. 2 is a graph showing a relationship between endurance time and increase in transfer voltage (resistance value)

More specifically, a relationship between an energization blank rotation time and an increase in resistance (increase in transfer voltage) in the case where the conventional secondary transfer roller 15A is subjected to continuous blank rotation under energization, is shown by a curve (-o-: ion-conductive type) in FIG. 2.

In this embodiment, evaluation is performed in such an environment that an effect is easily understandable, i.e., in a low-humidity environment (23° C. and 5% RH) in which a difference in performance is liable to arise in a short time. Further, a constant current of 20 μA is continuously passed during energized blank rotation.

Referring again to FIG. 9, the evaluation item ("increase in resistance after continuous energization") is indicated by "o" or "x" according to the following criterion.

x: After 500 hours of continuous energization, an applied voltage (resistance) at the time of constant-current control exceeds two times an initial applied voltage.

o: The applied voltage is not more than two times the initial applied voltage (i.e., the case other than the cases of "x").

For example, when the above criterion is applied to the (conventional ion-conductive type) secondary transfer roller 15A, as apparent from FIG. 2, the initial applied voltage (transfer voltage) is 3000 V and the applied voltage after continuous energization for 500 hours is 7000 V which exceeds two times the initial applied voltage value. Accordingly, the conventional transfer roller 15A is evaluated as "x" in accordance with the above-mentioned criterion.

The results of the table shown in FIG. 9 are also shown as a graph in FIG. 3. From FIG. 3, in order to suppress an increase in resistance after continuous energization, it has been found that the surface bubble-containing density A (g/cm$^3$) and the surface bubble-deaerated density B (g/cm$^3$) are required to satisfy the following conditions:

$$B \leqq (5/3) \times A - 0.3, \text{ and}$$

$$B \geqq 0.6.$$

In a range of $B>(5/3)\times A-0.3$, the surface bubble-containing density A is considerably smaller than the surface bubble-deaerated density B, so that a tendency such that a degree of formation of air bubbles at the roller surface is increased is intensified. The increase in degree of roller surface bubble formation leads to a further increase in interstice liable to cause discharge, thus being liable to cause an increase in resistance due to discharge.

Further, if $B<0.6$, an amount of foaming portion within the roller is considerably increased to further increase interstices liable to cause discharge within the roller, thus also being liable to cause resistance increase due to discharge.

Incidentally, with respect to the same roller, the surface bubble-deaerated density B value is not less than the surface bubble-containing density A value in nature.

In another aspect, in the above-mentioned conditions (ranges) capable of suppressing the resistance increase, the associated transfer roller fails to satisfy the following items (i) and (ii) in image formation in some cases:

(i) Hollow image, and (ii) Backside contamination.

With respect to (i) hollow image, it has been clarified that an amount of foaming portion within the roller becomes smaller if the surface bubble-deaerated density B exceeds 0.75 g/cm$^3$, thus increasing a hardness of the roller to abruptly deteriorate a degree of hollow image. This may be attributable to such a phenomenon that a transfer nip becomes small (i.e., a transfer nip width becomes narrow) at the secondary transfer portion T2 (as shown in FIG. 1) if the roller hardness is increased, thus resulting in an increase in pressure within the transfer nip. Accordingly, when the surface bubble-deaerated density B is not more than 0.75 g/cm$^3$, the transfer roller can satisfy image forming characteristic in terms of hollow image.

With respect to backside contamination, in this embodiment, particular cleaning means for cleaning the secondary transfer roller 15 is not employed from the viewpoints of cost reduction and space saving. However, the backside contamination is prevented by applying a transfer bias voltage to the secondary transfer roller 15 at the time when the recording material P is not present at the secondary transfer portion, thereby to remove the toner particles attached to the surface of the transfer roller 15. In this case, a degree of the backside contamination becomes worse if a difference between the surface bubble-deaerated density B and the surface bubble-containing density A (i.e., B−A) is less than 0.02 g/cm$^3$. This is because the smaller difference (B−A <0.02 g/cm$^3$) means such a state that an amount of foaming portion at the roller surface is smaller, i.e., a state such that the surface of the secondary transfer roller 15 becomes smoother, so that toner particles cannot enter the foaming portion at the surface of the secondary transfer roller 15 to be always present at the roller surface, thus being liable to stay at the roller surface with respect to a component of toner particles which cannot be removed even by applying the transfer bias voltage described above, thereby to be liable to cause the backside contamination.

Accordingly, the transfer roller 15 is required to have a surface foaming portion to some extent, i.e., a difference (B−A) between the surface bubble-deaerated density B and the surface bubble-containing density A up to a point.

According to this embodiment, it has been confirmed that the difference (B−A) is required to be not less than 0.02 g/cm$^3$ in order to prevent the backside contamination.

As described above, when the surface bubble-containing density A and the surface bubble-deaerated density B satisfy the following conditions:

$$A+0.02 \leqq B \leqq (5/3)\times A-0.3, \text{ and}$$

$$0.60 \leqq B \leqq 0.74,$$

it becomes possible to solve the problems of hollow image and the backside contamination at the same time while preventing the increase in resistance after continuous energization of the secondary transfer roller 15.

<Embodiment 2>

In this embodiment, comparison was made with respect to a plurality of transfer rollers having different thicknesses of the transfer roller (of resistance layer exclusive of the core metal) and different diameters of the core metal in addition to different combinations of the surface bubble-containing density A and the surface bubble-deaerated density B.

More specifically, the transfer rollers adjusted to have volume resistivities of $7\times10^7$–$1.2\times10^8$ ohm.cm in an environment of 23° C. and 50% RH were used. The outer diameter of the transfer rollers is set to 24 mm similarly as in Embodiment 1 described above, but the diameter of the core metal 15*a* was changed. In addition thereto, the resistance layers were changed in their volume resistivities by changing their thickness in a range of 2–10 mm.

The evaluation results are shown in FIG. 10.

In the table shown in FIG. 10, evaluation is performed according to the following criteria.

<Crack> o: Not occurred.

oΔ: Slightly occurred but was at a practically acceptable level.

Δ: Occurred noticeably.

x: Occurred very noticeably.

<Slack> o: Not occurred.

Δ: Somewhat occurred and adversely affected resultant images.

x: Large slack occurred.

As shown in FIG. 10, if the relationships between the surface bubble-containing density A and the surface bubble-deaerated density B described in Embodiment 1 were satisfied, it was possible to achieve the objective, i.e., acceptable level (o), in terms of resistance increase after continuous energization. However, with respect to the crack at the roller surface, when the resistance layer thickness was not more than 3 mm, the crack occurred very noticeably (x), and when the thickness was 4 mm, the crack occurred noticeably (Δ). On the other hand, when the thickness was 4.5–5.5 mm, a slight crack occurred but was at a practically acceptable level (oΔ), and when the thickness was not less than 6 mm, the crack did not occur (o). If the crack is caused to occur, resultant performances in terms of not only an image forming characteristic but also conveyance characteristic of the recording material become worse. Accordingly, the thickness of the resistance layer may preferably be not less than 4.5 mm, and may more preferably be not less than 6 mm. However, in order to increase the resistance layer thickness, if the core metal diameter was made smaller, a slack was smaller (not more than 10 mm), a slack was caused to occur at a central portion of the transfer roller in its longitudinal direction, thus leading to an occurrence of such a phenomenon that the transfer roller causes transfer failure at its central portion. As shown in FIG. 10, the slack was not caused to occur (o) when the core diameter was not less than 12 mm but was caused to occur somewhat and adversely affected resultant images (Δ) when the core diameter was 10 mm. Further, when the core diameter was not more than 8 mm, a large slack was caused to occur (x).

In view of such a phenomenon, a further comparison was performed by changing the thickness of the resistance layer in a state that the core metal diameter is fixed at 12 mm.

The results are shown in FIG. 11. As apparent from the table shown in FIG. 11, the slack of the transfer roller is remedied by setting the core metal diameter to be not less than 12 mm, and satisfactory results are attained with respect to the occurrence of crack due to continuous energization.

From the above-mentioned results of comparisons it was confirmed that the thickness of the resistance layer of the transfer roller may preferably be not less than 4.5 mm, more preferably be not less than 6 mm.

<Embodiment 3>

In this embodiment, comparison was made with respect to a plurality of transfer rollers having various transfer roller pressures, at a secondary transfer portion T2 (FIG. 1), which were considered to largely affect an image forming characteristic and a conveyance characteristic.

The evaluation results are shown in FIG. 12. More specifically, evaluation is performed in terms of hollow image, transfer failure at the time of superposition of toner images, and a change in resistance after continuous energization.

In each evaluation item, evaluation criteria are as follows:

o: A level of no problem at all.

Δ: A slight failure occurred but a level thereof is practically acceptable.

x: A level that noticeable failure occurred.

It was confirmed that the transfer roller pressure did not adversely affect the change in resistance after continuous energization even when the pressure of the transfer roller (secondary transfer roller 15) to the intermediary transfer belt 7 was changed between $1.2\times10^3$ Pa (pascals) and $5.0\times10^5$ Pa.

However, when the pressure was lowered, a transfer failure of solid secondary-color image (red (superposition of red with magenta), blue (superposition of magenta with cyan) and green (superposition of yellow with cyan)) was caused to occur. On the other hand, when the pressure was increased a hollow image (dropout of a line image or a character image at a central portion) was caused to occur.

Accordingly, the secondary transfer nip pressure may preferably be not less than $2.5\times10^3$ P and not more than $3.0\times10^5$ Pa, more preferably be not less than $7.0\times10^3$ Pa and not more than $2.0\times10^5$ Pa.

In the above-mentioned Embodiments 1–3, the intermediary transfer belt (intermediary transfer member) 7 corresponds to the image bearing member; the secondary transfer roller 15 corresponds to the transfer member; and the recording material P corresponds to another member.

Further, in Embodiments 1–3, the transfer roller according to the present invention was employable as the secondary transfer roller 15 but may also be applicable to primary transfer rollers 5*a*–5*d*. In this case, the photosensitive drums 1*a*–1*d* correspond to the image bearing member; the primary transfer roller 5*a*–5*d* correspond to the transfer member; and the intermediary transfer belt 7 corresponds to another member.

<Embodiment 4>

In all the Embodiments 1–3 described above, the transfer roller (transfer member) of the present invention is employed as the secondary transfer roller in the case of using the intermediary transfer member (intermediary transfer belt) but is not limited thereto.

In this embodiment, the transfer roller of the present invention is used in a black-and-white (monochrome) image forming apparatus which does not include the intermediary transfer member.

FIG. 6 shows a schematic structure of the black-and-white image forming apparatus.

Referring to FIG. 6, the image forming apparatus includes a drum-type electrophotographic photosensitive member (photosensitive drum) 31 as an image bearing member. Around the photosensitive member 31; a charge roller (charging means) 32, an exposure apparatus (exposure means) 33, a developing apparatus (developing means) 34, a transfer roller (transfer member) 35, and a cleaning apparatus (cleaning means) 36 are disposed substantially in this order along a rotation direction (of an arrow R31) of the photosensitive drum 31.

In the image forming apparatus, the surface of the photosensitive drum 31 is uniformly charged by the charge roller 32 and is subjected to exposure to light by the exposure apparatus 33 to form thereon an electrostatic latent image. Thereafter, the electrostatic latent image is developed as a toner image by attaching a toner to the surface of the photosensitive drum through the developing apparatus 34. The toner image is supplied to a transfer portion (transfer nip portion) T, formed between the photosensitive drum 31 and the transfer roller 35, to which the recording material P is also sent in a direction of K by unshown rollers including a paper supply roller, a conveyance roller and a registration roller.

The recording paper P is nipped and conveyed at the transfer portion T. At that time, a transfer bias voltage is applied to a core metal 35*a* of the transfer roller 35, whereby the toner image on the photosensitive drum 31 is transferred onto the recording material P.

The residual toner remaining on the surface of the photosensitive drum 31, i.e., not transferred onto the recording material P at the time of the toner image transfer, is removed by the cleaning apparatus 36. On the other hand, the toner image transferred onto the recording material P is fixed on the surface of the recording material P by a fixing apparatus (not shown).

In the above-described image forming apparatus, as the transfer roller 35, the transfer roller described in Embodiment 1 was used.

Accordingly, also in this embodiment, it is possible to achieve the similar effects as in Embodiment 1.

In this embodiment, the photosensitive drum 31 corresponds to the image bearing member; the transfer roller 35 corresponds to the transfer member, and the recording material P corresponds to another member.

What is claimed is:

1. A charging member for being contactably disposed to an image bearing member and being supplied with a bias voltage, comprising:

a resistance layer having an ionic electrical conductivity, wherein said resistance layer comprises a foamed elastic member and satisfies the following relationships:

$$B\leqq(5/3)\times A-0.3, \text{ and}$$

$$B\geqq0.6,$$

wherein A represents a surface bubble-containing density measured, in a state that air bubbles are attached to the surface of said resistance layer, by immersion method according to JIS Z 8807; and B represents a surface bubble-deaerated density measured, in a state that said air bubbles are removed from the surface of said resistance layer, by immersion method according to JIS Z 8807.

2. A member according to claim 1, wherein said resistance layer has a volume resistivity of not less than $1\times10^6$ ohm.cm and not more than $1.0\times10^{10}$ ohm.cm, measured in an environment of a temperature of 23° C. and a relative humidity of 50%.

3. A member according to claim 1, wherein said resistance layer has a volume resistivity of not less than $1\times10^7$ ohm.cm and not more than $1.0\times10^9$ ohm.cm, measured in an environment of a temperature of 23° C. and a relative humidity of 50%.

4. A member according to claim 1, wherein said resistance layer satisfies the following relationship:

$$0.6\leqq B\leqq0.75.$$

5. A member according to claim 1, wherein said resistance layer satisfies the following relationship:

$$A+0.02\leqq B\leqq(5/3)\times A-0.3.$$

6. A member according to claim 1, wherein said charging member abuts against the image bearing member at an abutting pressure of not less than $2.5\times10^3$ Pa and not more than $3.0\times10^5$ Pa.

7. A member according to claim 1, wherein said charging member abuts against the image bearing member at an abutting pressure of not less than $7.5\times10^3$ Pa and not more than $2.0\times10^5$ Pa.

8. A member according to claim 1, wherein said charging member further comprises a core metal on which said resistance layer is disposed, said resistance layer having a thickness of not less than 4.5 mm.

9. A member according to claim 1, wherein said charging member further comprises a core metal on which said resistance layer is disposed, said resistance layer having a thickness of not less than 6.0 mm.

10. A member according to claim 1, wherein said resistance layer comprises a foamed elastic member having a closed cell.

11. An image forming apparatus, comprising:

image forming means for forming an image on an image bearing member, and a transfer member for being contactably disposed to the image bearing member and transferring the image formed on the image baring member by applying a bias voltage to said transfer member;

wherein said transfer member comprises a resistance layer having an ionic electrical conductivity, said resistance layer comprising a foamed elastic member and satisfying the following relationships:

$$B\leqq(5/3)\times A-0.3, \text{ and}$$

$$B\geqq0.6,$$

wherein A represents a surface bubble-containing density measured, in a state that air bubbles are attached to the surface of said resistance layer, by immersion method according to JIS Z 8807; and B represents a surface bubble-deaerated density measured, in a state that said air bubbles are removed from the surface of said resistance layer, by immersion method according to JIS Z 8807.

12. An apparatus according to claim 11, wherein said resistance layer has a volume resistivity of not less than $1\times10^6$ ohm.cm and not more than $1.0\times10^{10}$ ohm.cm, measured in an environment of a temperature of 23° C. and a relative humidity of 50%.

13. An apparatus according to claim 11, wherein said resistance layer has a volume resistivity of not less than $1\times10^7$ ohm.cm and not more than $1.0\times10^9$ ohm.cm, measured in an environment of a temperature of 23° C. and a relative humidity of 50%.

14. An apparatus according to claim 11, wherein said resistance layer satisfies the following relationship:

$$0.6\leqq B\leqq0.75.$$

15. An apparatus according to claim 11, wherein said resistance layer satisfies the following relationship:

$$A+0.02\leqq B\leqq(5/3)\times A-0.3.$$

16. An apparatus according to claim 11, wherein said transfer member abuts against the image bearing member at an abutting pressure of not less than $2.5\times10^3$ Pa and not more than $3.0\times10^5$ Pa.

17. An apparatus according to claim 11, wherein said transfer member abuts against the image bearing member at an abutting pressure of not less than $7.5\times10^3$ Pa and not more than $2.0\times10^5$ Pa.

18. An apparatus according to claim 11, wherein said transfer member further comprises a core metal on which said resistance layer is disposed, said resistance layer having a thickness of not less than 4.5 mm.

19. An apparatus according to claim 11, wherein said transfer member further comprises a core metal on which said resistance layer is disposed, said resistance layer having a thickness of not less than 6.0 mm.

20. An apparatus according to claim 11, wherein said resistance layer comprises a foamed elastic member having a closed cell.

* * * * *

UNITED STATES PATENT AND TRADEMARK OFFICE

CERTIFICATE OF CORRECTION

PATENT NO. : 7,039,351 B2
APPLICATION NO. : 10/643990
DATED : May 2, 2006
INVENTOR(S) : Tomizawa It is certified that error appears in the above-identified patent and that said Letters Patent is hereby corrected as shown below:

DRAWING SHEET NO. 2 of 11:
Figure 3, “BUBBLE-CONTAINIG” should read --BUBBLE-CONTAINING--.

COLUMN 4:
Line 38, “baring” should read --bearing--.

COLUMN 5:
Line 29, “thickness” should read --thicknesses--.

COLUMN 6:
Line 5, “regist” should read --register--.
Line 17, “charges” should read --chargers--.
Line 26, “and” (second occurrence) should read --are--.

COLUMN 8:
Line 33, “my” should read --may--.
Line 57, “image” should read --toner--.

COLUMN 13:
Line 33, “roller” should read --rollers--.

COLUMN 15:
Line 19, “baring” should read --bearing--.

Signed and Sealed this

Fourteenth Day of August, 2007

JON W. DUDAS
*Director of the United States Patent and Trademark Office*